US009655464B2

(12) United States Patent
Cozadd

(10) Patent No.: US 9,655,464 B2
(45) Date of Patent: May 23, 2017

(54) VENTILATED TRAY WITH RISER

(71) Applicant: Union Joints, Clarkston, MI (US)

(72) Inventor: Aaron Cozadd, Clarkston, MI (US)

(73) Assignee: Union Joints, Clarkston, MI (US)

( * ) Notice: Subject to any disclaimer, the term of this patent is extended or adjusted under 35 U.S.C. 154(b) by 854 days.

(21) Appl. No.: 14/041,542

(22) Filed: Sep. 30, 2013

(65) Prior Publication Data

US 2014/0091096 A1 Apr. 3, 2014

Related U.S. Application Data

(60) Provisional application No. 61/708,142, filed on Oct. 1, 2012.

(51) Int. Cl.
*A47J 37/07* (2006.01)
*A47G 23/06* (2006.01)

(52) U.S. Cl.
CPC ..... *A47G 23/0683* (2013.01); *A47G 23/0625* (2013.01)

(58) Field of Classification Search
CPC .... A47G 19/02; A47G 19/027; A47G 21/007; A47G 23/06; A47G 23/0625; A47G 23/0683; A47G 23/08; A47G 2021/008
See application file for complete search history.

(56) References Cited

U.S. PATENT DOCUMENTS 1,316,365 A 9/1919 Jackson et al.
2,625,020 A * 1/1953 Oliver ..... A47G 19/02 220/771
2,650,485 A 9/1953 La Greca
4,785,968 A 11/1988 Logan et al.
4,865,219 A 9/1989 Logan et al.
5,076,434 A 12/1991 Hoffman, Jr.
5,503,063 A 4/1996 Sebald
5,526,735 A 6/1996 Hacker et al.
7,219,663 B2 * 5/2007 Cuomo ..... A47J 36/36 126/25 R
7,850,035 B2 12/2010 Lion et al.
(Continued)

FOREIGN PATENT DOCUMENTS

GB 1252233 A * 11/1971 ..... A47G 23/06

*Primary Examiner* — Dana Ross
*Assistant Examiner* — Brandon Harvey
(74) *Attorney, Agent, or Firm* — Endurance Law Group, PLC

(57) ABSTRACT

A serving tray configured to hold fresh baked pizza and hot-served food items in a prolonged hot and crispy state. The tray comprises a circular ventilated platform made of a perforated inner region surrounded by a solid rim. Stand-off dividers form a plurality of segregated breathing chambers below the ventilated platform. The stand-off dividers guide moisture vapor from the hot baked food item through the ventilated platform and toward a cool remote surface where the water vapors condense. External air drafts are obstructed by the stand-off dividers. The stand-off dividers include one annular riser divider and two internal cross-brace dividers that together form four sector-shaped breathing chambers. A flat handle extends between the two cross-brace dividers inside the annular riser divider. As slices of pizza are removed, the remaining portions of pizza on the tray stay hot and crispy as radiated heat is reflected within the still breathing chambers.

13 Claims, 4 Drawing Sheets

(56) References Cited

U.S. PATENT DOCUMENTS

| | | | | |
|---|---|---|---|---|
| 7,861,886 | B2 | 1/2011 | Lion et al. | |
| D654,297 | S | 2/2012 | Lion et al. | |
| D655,968 | S | 3/2012 | Lion et al. | |
| D655,969 | S | 3/2012 | Lion et al. | |
| 8,203,107 | B2 | 6/2012 | Lion et al. | |
| D673,005 | S | 12/2012 | Lion et al. | |
| 2004/0234653 | A1 | 11/2004 | Cogley et al. | |
| 2006/0180031 | A1* | 8/2006 | Carlson | A47G 19/022 99/352 |
| 2011/0232102 | A1* | 9/2011 | Holmes | A47G 23/06 30/123 |
| 2012/0219684 | A1 | 8/2012 | Fritz-Jung et al. | |
| 2012/0251684 | A1 | 10/2012 | Lion et al. | |

* cited by examiner

VENTILATED TRAY WITH RISER

CROSS REFERENCE TO RELATED APPLICATIONS

This application claims priority to Provisional Patent Application No. 61/708,142 filed Oct. 1, 2012, the entire disclosure of which is hereby incorporated by reference and relied upon.

BACKGROUND OF THE INVENTION

Field of the Invention

The invention relates generally to a food serving tray, and more particularly to a serving tray that will sustain fresh-baked pizza or bread or other hot-served food items in a hot and crispy state for consumption.

Description of Related Art

Many food items are served immediately after baking for consumption. Examples include loaf bread, bread sticks and rolls, quiche, pies, and other crust-type items. Pizza is another example and will serve hereinafter as a convenient representative example for all types of hot baked food items that have a crust. As is commonly-known, pizza is a baked compilation of flat bread topped with sauce, cheese and (usually) various meats and vegetables. Many restaurants specialize in serving house-baked pizza. A pizza restaurant will gain a highly coveted favorable reputation when pizza is made to order using high-quality, fresh ingredients and served hot (from the oven) with a crispy crust. Any restaurant is capable of using high-quality, fresh ingredients, but consistently achieving an ideal crispy crust is very difficult. An ideal crispy crust on every pizza served to hundreds of customers every week demands skilled preparation, and proper execution of the baking process.

More and more restaurants are gaining popularity as sit-down dining destinations by specializing in so-called "gourmet" pizza. Such higher-end restaurants therefore strive to cook and serve pizza of exceptionally high quality on a consistent basis. Even if a restaurant is able to consistently serve excellent tasting, hot pizza with a perfectly crispy crust, commercial success will not be certain unless the dining ambiance is favorable. Dining ambiance includes not only décor and atmosphere, but also the quality of the prepared food must be sustained long after serving so that the patron has time to delight in a leisurely eating experience. That is to say, if a pizza is served perfectly tasting and hot and crispy to a patron but the taste, temperature and/or texture of the food deteriorates too rapidly, the patron is not likely to consider the overall experience enjoyable. There is therefore a need to make great food, and also to prepare and serve the food in such a way that it can be savored in its original high-quality state for a reasonable period of unhurried dining time. Toward this end, it has proven extremely difficult to sustain the hot and crispy character of a perfectly prepared pizza for more than a few brief and fleeting moments.

In a sit-down pizzeria restaurant, immediately after a pizza is baked it is typically sliced into pieces and then placed on an un-perforated circular metal serving tray for presentation to the patron. An example of a traditional solid serving tray is shown in FIG. 1. The tray is sometimes placed on an elevated stand as shown. When served on this type of traditional solid tray, the pizza crust will quickly lose its initial crispness and become unpleasantly soggy. Soggy crust results largely from water vapors emanating from the bottom of freshly baked crust and forming condensation.

The trapped moisture between the crust bottom and the tray is re-absorbed by the crust turning it soggy. Soggy crust is undesirable to eat. Soggy crust is also undesirable to handle by patrons that eat pizza in the traditional manner without silverware.

There also exists in the prior art a device known as a pizza screen (not shown). A pizza screen is circular like a pizza and used typically as a supporting under-layer during the baking process. A pizza screen is not used as a serving utensil for the finished pizza. The pizza screen is characterized by an expanded metal mesh which allows the hot oven air to circulate around the crust bottom, supposedly cooking it more evenly. If someone tried to use a pizza screen for serving purposes, the results would be predictably undesirable. A pizza screen placed directly on a solid surface, like a dining table, would result in the crust rapidly turning soggy in the same manner as described above with a traditional solid serving tray. On the other hand, a pizza screen placed on an elevated stand like that shown in FIG. 1, would result in the crust rapidly cooling as the underside of the pizza would be exposed to open air flow.

US 2004/0234653 to Cogley, published Nov. 25, 2004, discloses a frozen pizza packing tray that can be used upside-down to microwave cook a pizza. Holes in the tray platform pass steam generated by the pizza during cooking. The steam becomes trapped underneath the platform and is deemed useful to the cooking process. In some embodiments, side vent apertures control venting of the steam. The Cogley device is not intended for serving pizza. The device is manufactured from paper-based, disposable microwaveable materials without additional support of the platform and therefore the top surface is structurally insufficient for cutting pizza. The top surface of the device includes only a limited number of widely-spaced apertures for the steam to move through, too few to prevent trapped moisture. If a user attempted to use the tray for serving, numerous shortcomings would become evident. The crust would quickly become soggy due to the minimal and widely-spaced apertures in its platform and the moisture-absorbing nature of the material. The weak material could soften and soon fail under the weight of the pizza and normal human interactions. The crust would quickly become cold after the first slice of pizza is removed, as heat would escape from the entire area under the platform and also would be immediately exposed to air drafts.

U.S. Pat. No. 4,785,968 to Logan et al., issued Nov. 22, 1988, discloses a double-wall pizza serving platter configured for serving hot pizza pan without damaging a dining table. The hot pizza rests directly on a perforate platform that is suspended above a solid base by a plurality of circumferentially spaced radial ribs. Steam and heat released from a hot pizza passes through the perforated platform then immediately escapes through the space between the ribs. A user attempting to use the Logan device to serve hot pizza would be disappointed in its performance for a few reasons. The open double-wall design provides a direct pathway for heat released from the hot pizza to escape to the outside and cool drafts to move in below the pizza. As slices of pizza are removed from the pan, larger and larger air pathways are created allowing for the accelerated escape of heat. Consequently, a pizza served on the Logan devise quickly cools. Moreover, the close-spacing between the platform and base may tend to condense steam emitted from the crust as liquid water in close proximity to the platform thereby inviting resorption of water back into crust. Thus, a patron served pizza on the Logan device is likely to experience a rapidly cooled pizza with an increasingly soggy crust.

U.S. Pat. No. 5,076,434 to Hoffman, Jr., issued Dec. 31, 1991, teaches a stackable ventilated support tray for storing and shipping uncooked pizza dough shells. The tray has a perforated platform surrounded by a rim. Spacer pins and stabilizers are provided so that when stacked, the rim and platform of one tray is well-supported above a like tray below. The area below the pizza receiving platform of the tray is intentionally designed for ventilation to flow underneath the uncooked pizza dough in an attempt to keep it fresh. The Hoffman device is not intended for use to cook pizza or to serve a cooked pizza.

There is therefore a need for a hot baked food serving solution that permits an expertly prepared food item, such as pizza, to remain hot and crispy for the duration of an unhurried meal so that a patron's dining experience will be maximized.

BRIEF SUMMARY OF THE INVENTION

According to one aspect of this invention, a serving tray is configured to hold fresh baked food in a prolonged hot and crispy state. The tray comprises a ventilated platform having a food receiving upper surface and an opposite under surface. A plurality of stand-off dividers extend downwardly from the under surface and are arranged to form a plurality of breathing chambers below the ventilated platform. Each stand-off divider is configured to guide moisture vapor from a hot food item through the ventilated platform to condense on a remote surface while concurrently obstructing external air drafts. The result is that the food is kept warm and its crust crisp for an extended period. Each breathing chamber is isolated from the next adjacent breathing chamber so that it remains unaffected when a piece of the hot baked food is removed above a different breathing chamber. That is, the plurality of breathing chambers effectively divide the area below the ventilated platform so that less than all of the breathing chambers are exposed as slices of the food are removed for eating. Each breathing chamber that remains covered by hot food will continue to maintain the overlying food crust hot and crispy. Water vapor that condenses at a remote site, for example upon the surface of a table, is held far enough away from the food by the stand-off dividers so that moisture is not reabsorbed into its crust.

According to another aspect of this invention, a method of keeping fresh baked food in a prolonged hot and crispy state is disclosed. The method comprises placing hot baked food, such as pizza or the like, on a ventilated platform with the hot food radiating heat and emitting moisture vapors. The ventilated platform is supported in a spaced relation above a remote surface. A plurality of breathing chambers are established between the ventilated platform and the remote surface. Each breathing chamber is sequestered from the next adjacent breathing chamber and from external air drafts. A portion of the moisture vapors emitted from the hot food are independently guided though each breathing chamber to condense on the remote surface while concurrently reflecting the radiated heat back toward the food therein keeping the food hot and crispy.

By establishing a plurality of breathing chambers and segregating them from one another and from external air drafts, a fresh baked food, like pizza, may be kept hot and its crust crispy for an extended period. Each breathing chamber is constructed to independently guide a portion of the moisture vapors emanating from a fresh hot baked item to condense on the remote surface while concurrently reflecting the radiated heat back toward the food therein keeping the food hot and crispy. As a result, a patron eating the food will have the opportunity to leisurely enjoy an expertly prepared food item that remains hot and crispy for the duration of an unhurried meal, even as slices of the food are progressively removed for eating. The patron's dining experience is maximized, and in turn the reputation of the restaurant is substantially enhanced.

The present invention therefore overcomes the deficiencies found in prior art serving trays to enable a restaurant to serve high-quality baked foods like pizza and other similar baked items in such a way that the food can be savored in its original high-quality state for a reasonable period of unhurried dining time. In the case of pizza foods in particular, the plurality of breathing chambers in present invention sustain the hot and crispy character of a perfectly prepared pizza for patrons to enjoy in a relaxed manner by removing one slice at a time over the course of a leisurely meal.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Referring to the figures, wherein like numerals indicate like or corresponding parts throughout the several views, a serving tray configured to hold fresh baked food items, like pizza, in a prolonged hot and crispy state is generally shown at 100 in FIGS. 2-8. While the serving tray 100 can be used to serve many different types of fresh baked food items, those with bread or crust features traditionally eaten hot and crispy are of particular focus. A pizza 102 is used in a representative capacity throughout this application to stand for all types of baked food items that may be beneficially served with the present serving tray 100. It is to be understood that other baked food items can be substituted in most if not all instances where specific reference is made to pizza 102.

Figure 1:
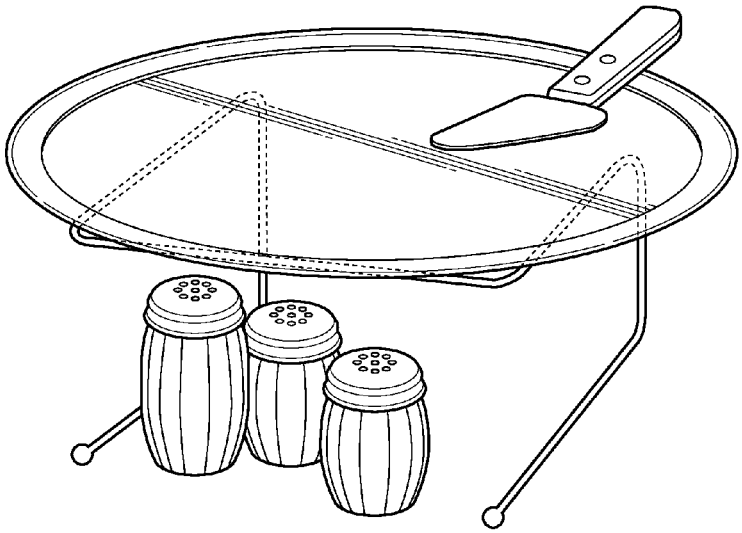
FIG. 1 Prior Art
FIG. 1 is a perspective view of a prior art serving tray.
Figure 2:
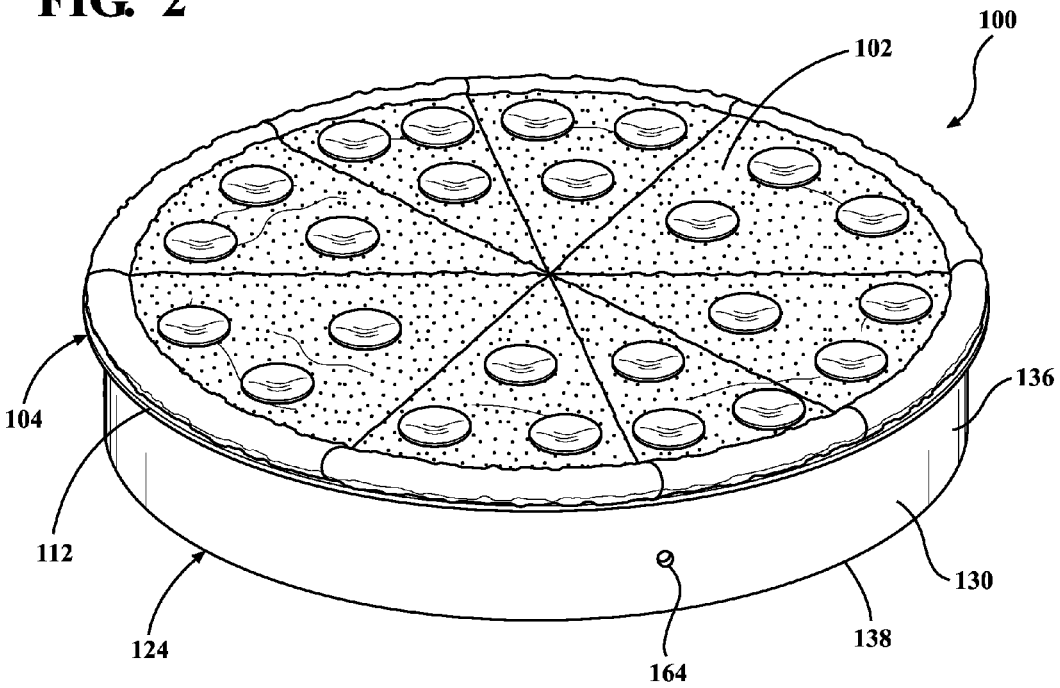
FIG. 2 is a perspective view of a pizza being served on a serving tray as disclosed herein.
Figure 3:
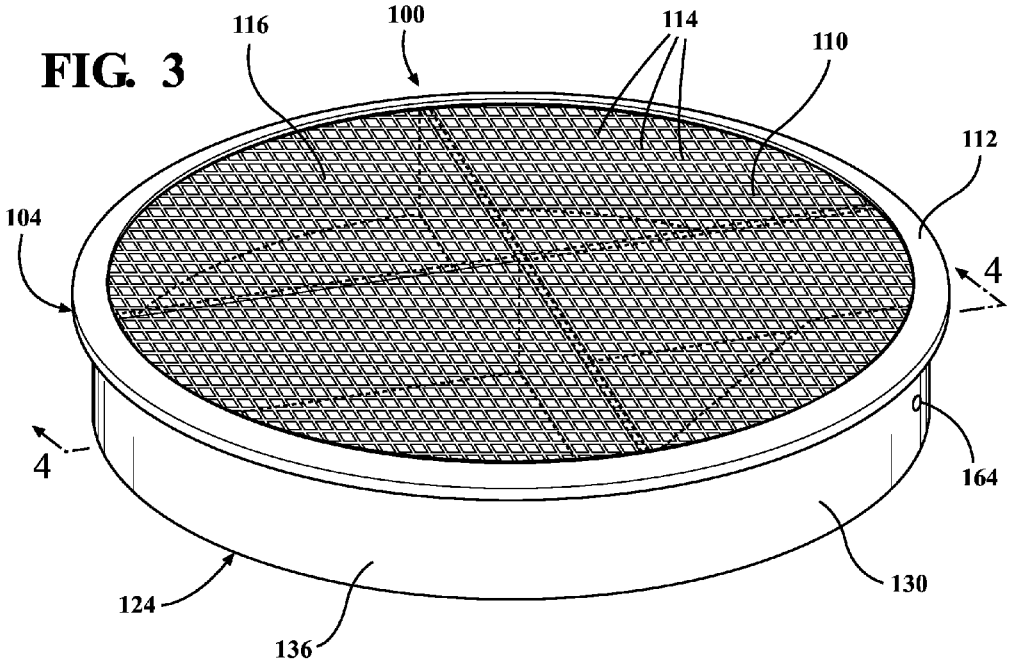
FIG. 3 is a perspective view of an embodiment of a serving tray.
Figure 4:
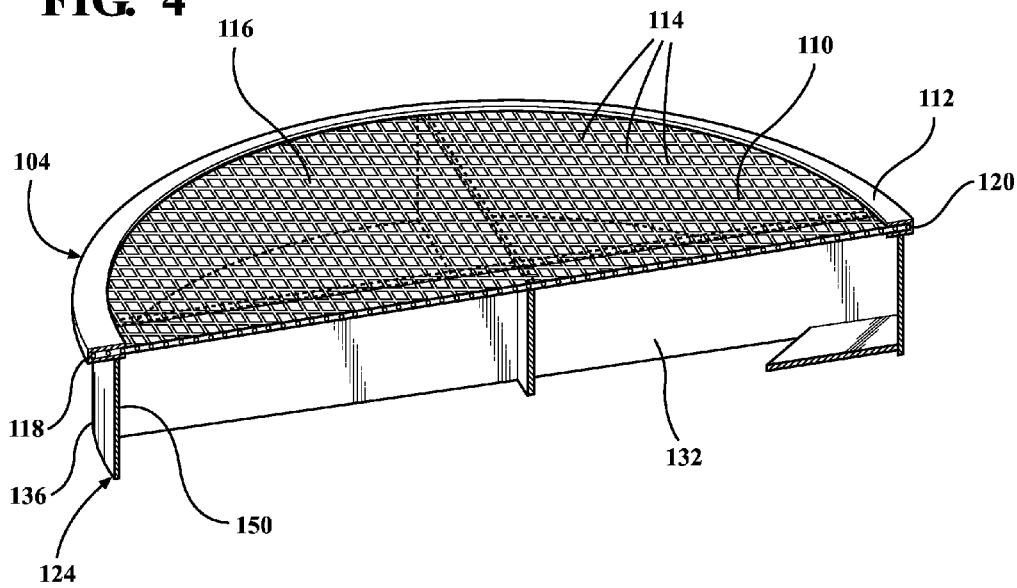
FIG. 4 is a cross-sectional view of the serving tray as taken generally along lines 4-4 of FIG. 3.
Figure 5:
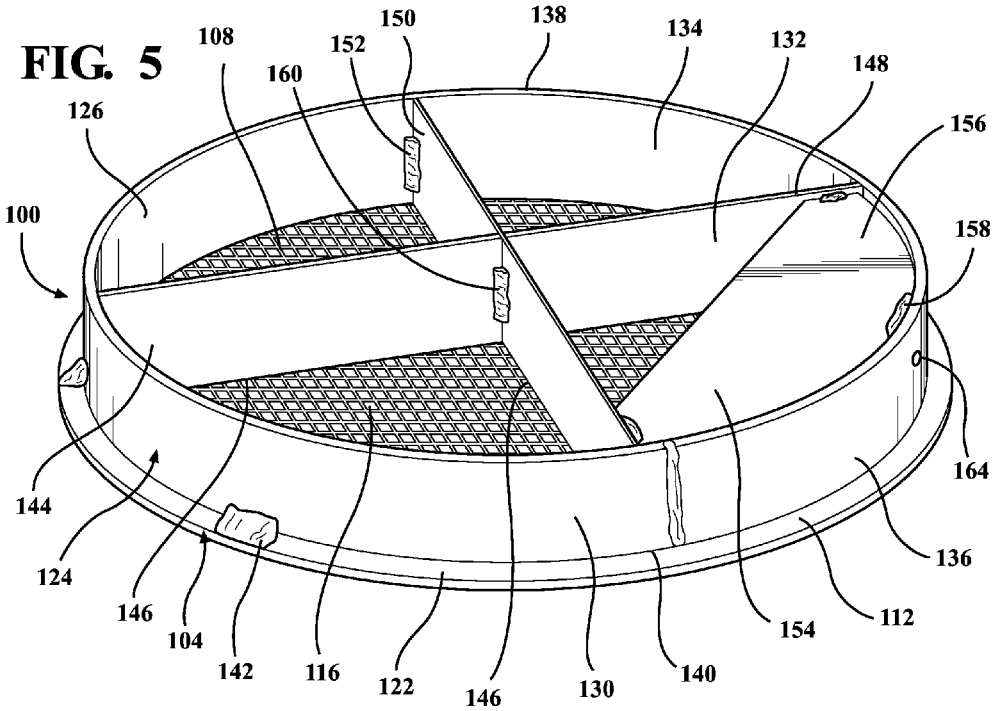
FIG. 5 is a bottom perspective view of the serving tray illustrated in FIG. 3.
Figure 7:
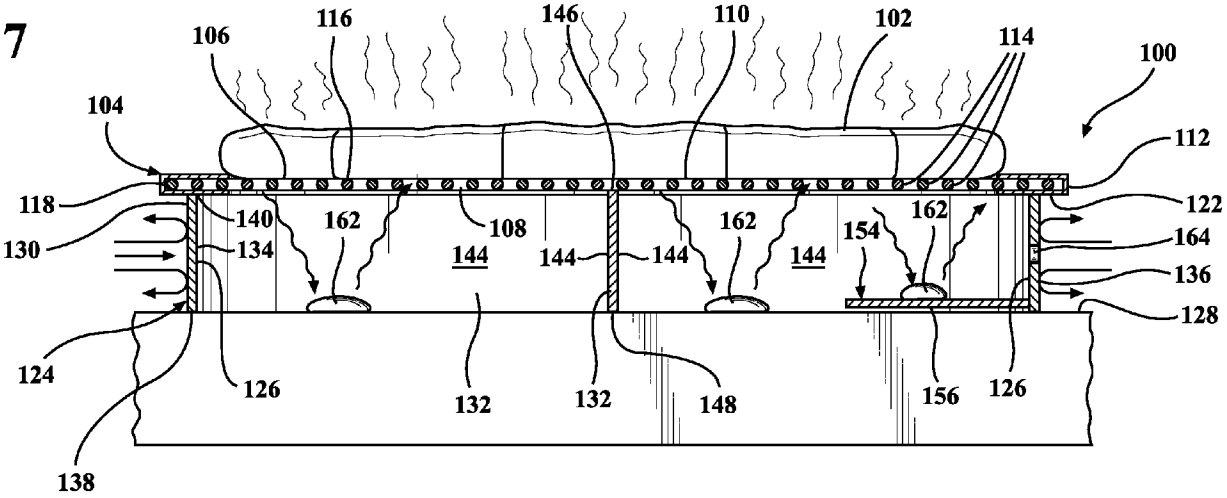
FIG. 7 is a cross-sectional view of the serving tray as in FIG. 4 of a serving tray served with hot pizza.
Figure 8:
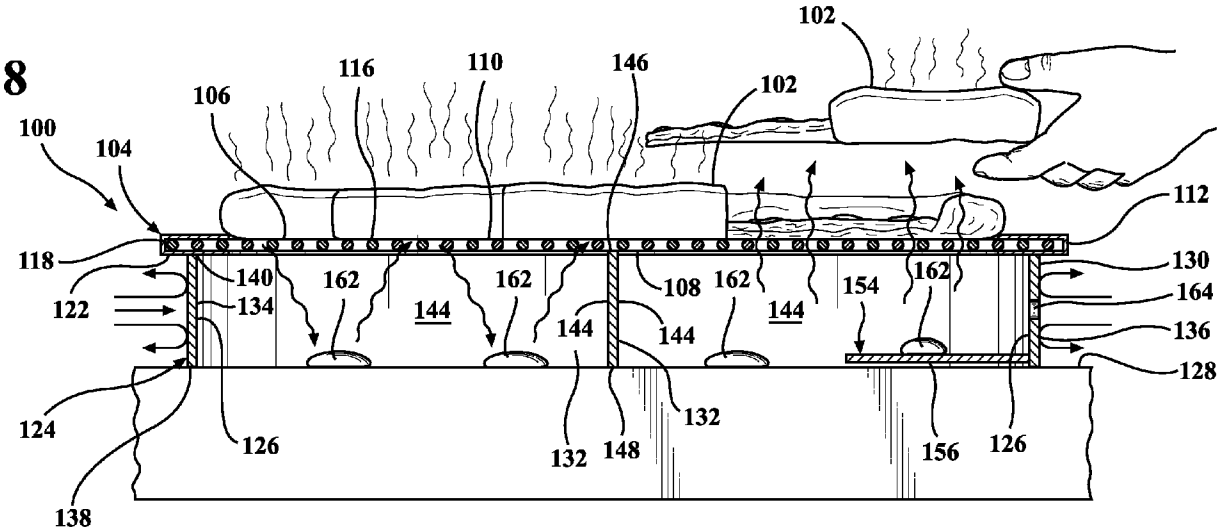
FIG. 8 is a cross-sectional view as illustrated in FIG. 7 but showing a pizza slice removed.

FIGS. 2, 7 and 8 illustrate this embodiment with a hot pizza 102 served on the tray 100. As illustrated in FIGS. 3-4, the serving tray 100 comprises a ventilated platform, generally indicated at 104, with a pizza receiving upper surface 106 and an opposite under surface 108. The upper surface 106 of the platform 104 is generally flat circular and centered about a generally vertical central axis A although other enclosed shapes such as squares or rectangles are contemplated. The upper surface 106 also has an inner region 110 surrounded by a rim 112.

The ventilated platform 104 includes a plurality of apertures 114 contained within the inner region 110 to allow a generally unrestricted exchange of heat and moist vapor through the platform 104. In one preferred embodiment, the apertures 114 of the inner region 110 can be formed as a mesh 116 of the type commonly found in commercially available so-called expanded metal constructions. Expanded metal is a form of metal stock made by shearing a metal plate in a press, so that the metal stretches, leaving diamond-shaped voids surrounded by interlinked bars of the metal. Expanded metal is also sometimes referred to as perforated metal. Other metallic as well as non-metallic materials may be used to fabricate the ventilated platform 104, including food-grade plastics. The outer periphery of the mesh inner region 110 is defined by a peripheral edge 118.

As perhaps best shown in FIG. 4, the rim 112 has a U-shaped cross-section 120 with a bottom surface 122. The rim 112 encircles the inner region 110 and may be fabricated from a metallic material such as aluminum, steel or stainless steel. Non-metallic materials are also contemplated. The peripheral edge 118 of the inner region 110 is enclosed within the U-shaped cross-section 120 of the rim 112. In this manner, the ventilated platform 104 may be said to have a panel-and-frame construction where the inner region 110 is the panel portion and the surrounding rim 112 is the frame. The rim 112 binds the jagged, unfinished peripheral edge 118 and also adds a significant degree of structure support so that the ventilated platform 104 is not readily flexible.

In an alternative embodiment, not illustrated, the ventilated platform 104 may be formed of a single metal sheet or plate of relatively heavy or sturdy gauge rather than of the illustrated rim and mesh two-piece construction. Thus, the rim 112 and inner region 110 may be integrated into a monolithic structure while serving the same primary function of the ventilated platform 104. In this contemplated alternative embodiment, the inner region of the metal plate includes a plurality of apertures in the shape of small squares, circles or other geometric patterns that enable free passage of heat and vapor through the ventilated platform. The monolithic sheet could be manufactured from aluminum, other metals including steel or stainless steels, or non-metallic materials such as food-grade polymers. The thickness of such a platform made from sheet or plate material is preferably sufficient to provide a relatively rigid surface suitable for cutting the hot pizza on the serving tray with minimal deflection. The thickness of such a monolithic sheet may range from about 0.1"-0.2", however thicknesses outside this range may be apt depending on the material composition selected. The apertures formed in this embodiment of the ventilated platform may be formed by stamping or a cutting operation. The apertures may be placed so as to extend fully to the peripheral edge of the platform, thus effectively eliminating any characteristics of a rim feature, or stop short of the peripheral edge thus leaving a solid rim-like edge or frame around the apertures that is smooth to the touch. The latter option is generally preferred, although by no means exclusive.

A plurality of stand-off dividers, generally indicated at 124, extend downward (relative to the central axis A) from the under surface 108 of the ventilated platform 104, as illustrated in FIG. 4. The stand-off dividers 124 are preferably fabricated from sheet stock, such as 0.0625" to 0.125" thick aluminum or stainless steel. In the preferred embodiment where the ventilated platform 104 is circular, the stand-off dividers 124 collectively form a cylindrical shape below the under surface 108 centered about the central axis A that is somewhat smaller than the diameter of the ventilated platform 104. In cases where the ventilated platform 104 is non-circular, the stand-off dividers 124 may continue in the form of a cylindrical shape or have a complimentary shape to that of the ventilated platform 104.

The stand-off dividers 124 elevate the ventilated platform 104 above a remote surface 128 (such as a table or counter) and are also arranged to form therebetween a plurality of breathing chambers 126. In the illustrated embodiment, stand-off dividers 124 form four sector-shaped breathing chambers 126 arranged in a circular pattern. Other contemplated embodiments may include fewer or more breathing chambers 126. As a general proposition, and to a limited extent, more breathing chambers 126 are better than fewer for reasons that will become apparent. When a fresh-from-the-oven pizza 102 or other baked food item is placed on the ventilated platform 104, heat and moisture vapors emanate through its crust. The majority of exposed crust on a traditional pizza 102 appears along its bottom surface, which is that portion in direct contact with the ventilated platform 104. The plurality of stand-off dividers 124, when arranged as a group, are configured to guide radiant heat and moisture vapor emanating from the pizza 102 through the ventilated platform 104 toward the remote surface 128 while concurrently obstructing external air drafts. Each stand-off divider 124 is substantially impervious to external air drafts such that the breathing chambers 126 formed therebetween remain generally sequestered from external air exchanges when enclosed on top by a pizza 102 and on bottom by a suitable remote surface 128. Air trapped inside the breathing chambers 126 will remain relatively still except for natural convective currents generated by the heat of the overlaying pizza 102 opposite a relatively cold remote surface 128. The remote surface 128 may include for example, the top surface of a dining table or a serving counter. In other embodiments (not shown), the stand-off divider 124 may be closed off at bottom so that the remote surface is an integral portion of the serving tray. However, the depicted embodiment with open-bottom breathing chambers 126 that utilize the table or a counter as the remote surface 128 is preferred as being somewhat easier to wash/clean after use.

Radiant heat and moisture vapor emanating from the pizza 102 are illustrated by wavy arrows in FIGS. 7 and 8. The stand-off dividers 124 guide these emitted elements within the shelter of each breathing chamber 126 toward the substantially cooler remote surface 128. The piping hot pizza 102 opposite a relatively cool remote surface 128 will induce convectively circulating air currents within each breathing chamber 126. When the hot moisture vapor in the swirling air contacts the cool remote surface 128, the moisture condenses as droplets 162 on the remote surface 128. Any air inside the breathing chamber 126 that may circulate back toward the crust of pizza 102 thus has less moisture content than when first emitted, and therefore does not contribute to sogginess. In other words, the breathing chambers 126 have something of a dehumidifying effect that helps pull water away from the pizza 102 and deposit or collect the water on the remote surface 128. Meanwhile, the radiant heat energy emanating from the hot pizza 102 reflects within the breathing chamber 126 back up toward the pizza (upward directed wavy arrows) thereby keeping the pizza 102 warm. Concurrently, external air drafts are obstructed by the stand-off dividers 124 thus establishing each breathing chamber 126 as a quarantined or secluded greenhouse-like space that blocks out cool external drafts under the bottom of the pizza 102 while nurturing heat conservation to keep the overlying pizza 102 hot by reflecting back radiant heat and transforming moisture vapor into separated water droplets 162. A person eating the pizza 102 gains the pleasure of eating hot, crisp pizza 102 over the unhurried course of their meal.

Each stand-off divider 124 has a generally uniform axial height. In some embodiments, the uniform axial height is between about 0.5 and 3 inches, and preferably about 1.25 inches. In this latter example, the under surface 108 of the ventilated platform 104 is thus supported by the stand-off dividers 124 about 1.25 inches above the remote surface 128. The preferred height range (~0.5-3.0") results in breathing chambers 126 that perform optimally by retaining heat and deterring sogginess. If the stand-off dividers 124 are too tall, the breathing chambers 126 formed by stand-off dividers 124 will be too large. Heat will disperse and reflected radiant heat will have more opportunity to miss the pizza 102. On the other hand, if the stand-off dividers 124 are too short, the breathing chambers 126 formed thereby will not sufficiently separate the condensed water droplets 162 and/or will allow the remote surface 128 to become so hot that water vapor is not readily condensed.

The plurality of stand-off dividers 124 comprises at least one riser divider 130 and at least one cross-brace divider 132. The riser divider 130 is preferably annular and includes an inner wall 134, an outer wall 136, and a riser bottom edge 138. The riser bottom edge 138 is preferably flat and extends between the inner 134 and the outer walls 136 of the riser divider 130. A similar flat riser top edge 140 extends between the inner 134 and the outer walls 136 of the riser divider 130. The riser top edge 140 is directly attached to the ventilated platform 104, and more specifically to the bottom surface 122 of the U-shaped rim 112. A first weld interface 142 joins the riser top edge 140 to the bottom surface 122 of the rim 112, and is disposed along the outer wall 136 of the riser divider 130. Of course, other attachment methods are possible, as well as full integration in the case of molded and extruded manufacturing techniques.

In the illustrated embodiment, each breathing chamber 126 is segregated from the next adjacent breathing chamber 126 by a cross-brace divider 132. Two cross-brace dividers 132 are shown extending diametrically across the inner wall 134 of the riser divider 130 and perpendicularly intersecting one another at the central axis A. Of course, more than two or only one cross-brace divider 132 may be used, and it is not essential that the one or more cross-brace dividers 132 bisect the central axis A.

Each cross-brace divider 132 includes opposing side walls 144, a top ledge 146, a base 148, and opposite cross-brace ends 150. Each of the cross-brace ends 150 perpendicularly abut the inner wall 134 of the riser divider 130. In the illustrated embodiment, a second weld joint 152 is disposed between each of the cross-brace ends 150 and the inner wall 134 of the riser divider 130, however other attachment techniques are possible. Each of the top ledges 146 are preferably disposed in direct supporting contact with the under surface 108 of the ventilated platform 104 to increase the weight bearing capacity of the inner region 110. As a result, the inner region 110 has more than enough structural integrity to withstand the force of a knife used to cut the pizza 102 without excessive bowing of the ventilated platform 104. Each cross-brace divider 132 has an axial height generally equal to the uniform axial height of the riser divider 130. The riser bottom edge 138 and the base 148 of each cross-brace divider 132 are generally co-planar whereas the riser top edge 140 and the top ledge 146 of the cross-brace divider 132 are also generally co-planar. These co-planar alignments limit the movement of drafts between breathing chambers 126 and provide a stable support for the ventilated platform 104 in a parallel orientation above the remote surface 128.

Figure 6:
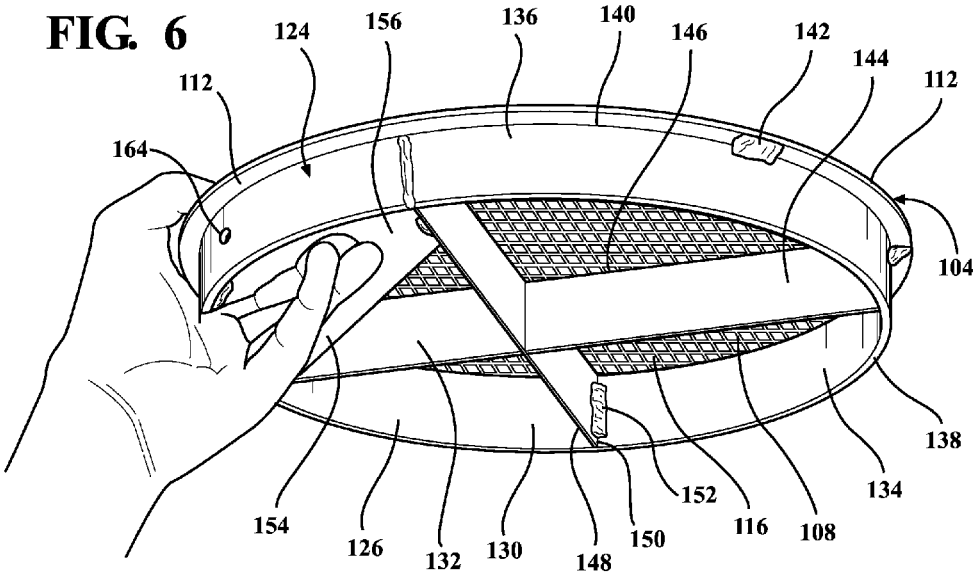
FIG. 6 shows a server's hand grasping the serving tray utilizing the tray handle.

A handle, generally indicated at 154, may be incorporated to facilitate handling of the serving tray 100 by a server who must carry the tray 100 with a piping hot pizza 102 (or other food item) from the kitchen to a dining area. The handle 154 is preferably formed of a metallic material or food-grade plastic and having a uniform thickness defined by opposing flat top and bottom panels 156. The handle 154 may be attached in any variety of ways. In one configuration, the handle 154 is attached inside the annular riser divider 130, adjacent to the riser bottom edge 138, and within one of the breathing chambers 126. The flat bottom panel 156 of the handle 154 is generally co-planar with the riser bottom edge 138 and the base 148 of each of the cross-brace dividers 132. The handle 154 in this embodiment is attached to opposing side walls 144 of two adjacent cross-brace dividers 132. A third weld joint 158 is disposed between the riser inner wall 134 of the riser divider 130 and the flat bottom panel 156 of the handle 154. A fourth weld joint 160 is disposed between opposing side walls 144 of two adjacent cross-brace dividers 132 and one of the flat top and bottom panels 156 of the handle 154. As shown in FIG. 6, the handle 154 is positioned to provide a point of leverage for the server's fingers when serving a hot pizza 102 resulting in a firm grip that keeps fingers comfortably spaced from the hot food. Recessed within one of the breathing chambers 126, the handle 154 will not obstruct stacking of the trays 100 when stored nor will the handle 154 take up dining table space when is served.

As shown in FIG. 4, a small drain hole 164 may be formed in the riser divider 130 directly above the handle 154. The drain hole 164 is preferably small enough to allow dish-washing water to drain from the otherwise cup-like region sometimes formed when the serving tray 100 is tipped on edge for washing purposes. However, the drain hole 164 is small enough to have only a negligible effect on the draft obstructing qualities of the one affected breathing chamber 126.

A method of keeping fresh baked pizza 102 in a prolonged hot and crispy state upon serving is illustrated in FIGS. 7 and 8. A hot pizza 102 radiating heat and emitting moisture vapors is supported in a spaced relation above a remote, horizontal and relatively cool surface 128 by a ventilated platform 104. A plurality of breathing chambers 126 are established between the ventilated platform 104 and the remote surface 128. Each breathing chamber 126 is sequestered from the next adjacent breathing chamber 126 and from external air drafts. Each breathing chamber 126 guides a portion of the moisture vapors emitted from the hot pizza 102 independently though each breathing chamber 126 to condense on the cool, remote surface 128 while concurrently reflecting radiant heat energy back toward the pizza. This guiding step includes accumulating moisture 162 condensed from the moisture vapor onto the remote surface 128. When a first slice of pizza 102 is removed from the serving tray 100, at least one of the underling breathing chambers 126 is exposed through the ventilated platform 104. Despite the first slice pizza 102 being removed, and heat venting immediately from the exposed breathing chamber 126, the remaining breathing chambers 126 still covered by pizza 102 continue to sequester external air drafts and function as described above to keep the remaining pieces of pizza 102 hot and crispy.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. A hot-food serving tray configured to hold fresh baked food in a prolonged hot and crispy state, said tray comprising:

a ventilated platform, said ventilated platform having a food receiving upper surface and an opposite under surface, a plurality of stand-off dividers extending downwardly from said under surface, said stand-off dividers being arranged to form therebetween a plurality of breathing chambers below said ventilated platform, each said stand-off divider configured to guide moisture vapor from a hot baked food through said ventilated platform to condense on a remote surface while concurrently obstructing external air drafts, said plurality of stand-off dividers comprising at least one riser divider and at least two cross-brace dividers, said at least two cross-brace dividers intersecting one another, said at least two cross-brace dividers generally surrounded by said at least one riser divider, said at least one riser divider being generally annular and including an inner wall, and a handle attached to at least one of said plurality of stand-off dividers, said handle at least partially disposed within one of said breathing chambers, wherein said handle extends between said at least two cross-brace dividers and said inner wall of said riser divider.

2. The tray of claim 1, wherein each said breathing chamber is segregated from the next adjacent breathing chamber by said at least two cross-brace dividers.

3. The tray of claim 1, wherein said at least two cross-brace dividers each extend diametrically across said inner wall of said riser divider.

4. The tray of claim 1, wherein said upper surface of said ventilated platform is generally circular and centered about a generally vertical central axis, wherein said at least two cross-brace dividers perpendicularly intersect one another at said central axis.

5. The tray of claim 1, wherein said at least one riser divider includes a continuous and unbroken outer wall, said riser divider including a riser bottom edge, said riser bottom edge extending between said inner and said outer walls of said riser divider, said riser divider including a riser top edge, said riser top edge extending between said inner and said outer walls of said riser divider.

6. The tray of claim 1, wherein said at least each said cross-brace divider includes opposing side walls, each said cross-brace divider including a top ledge and a base, each said cross-brace divider including opposite cross-brace ends, each said cross-brace end abutting said inner wall of said riser divider, and wherein each said top ledge is disposed in direct supporting contact with said under surface of ventilated platform.

7. The tray of claim 1, wherein said upper surface of said ventilated platform is generally circular and centered about a generally vertical central axis, said at least one riser divider including a riser bottom edge and a riser top edge, the axial distance between said riser bottom edge and said riser top edge defining a generally uniform axial height of said riser divider, each said cross-brace divider including a top ledge and a base, each said cross-brace divider having an axial height generally equal to said uniform axial height of said riser divider, said riser bottom edge and said base of each said cross-brace divider being generally co-planar, said riser top edge and said top ledge of each said cross-brace divider being generally co-planar.

8. The tray of claim 1, wherein each said stand-off divider is fabricated from a solid material that is substantially impervious to external air drafts such that said breathing chambers formed therebetween remain generally sequestered from external air exchanges when enclosed between a hot baked food and by a suitable remote surface.

9. The tray of claim 1, wherein said handle has a generally uniform thickness defined by opposing flat top and bottom surfaces, and said riser divider includes a drain hole adjacent said handle.

10. The tray of claim 1, wherein said upper surface of said ventilated platform is generally circular and centered about a generally vertical central axis, said stand-off dividers collectively forming a cylindrical shape below said under surface centered about said central axis.

11. The tray of claim 1, wherein said upper surface of said ventilated platform is generally circular and centered about a generally vertical central axis, each said stand-off divider having a generally uniform axial height.

12. The tray of claim 11, wherein said generally uniform axial height of each said stand-off divider is approximately 1.25 inches.

13. A pizza serving tray configured to hold fresh baked pizza in a prolonged hot and crispy state, said tray comprising:

a ventilated platform, said ventilated platform having a pizza receiving upper surface and an opposite under surface, said upper surface being generally flat, said upper surface being circular and centered about a generally vertical central axis, said upper surface having an inner region surrounded by a rim, said ventilated platform including a plurality of apertures, said plurality of apertures contained within said inner region, said rim including a bottom surface, said rim encircling said inner region, a plurality of stand-off dividers, said stand-off dividers extending downwardly from said under surface, said stand-off dividers collectively forming a cylindrical shape below said under surface centered about said central axis, said stand-off dividers arranged to form therebetween a plurality of breathing chambers, said breathing chambers positioned below said ventilated platform, each said stand-off divider configured to guide moisture vapor through said ventilated platform to condense on a remote surface while concurrently obstructing external air drafts, each said stand-off divider having a generally uniform axial height, said plurality of stand-off dividers comprising at least one riser divider and at least one cross-brace divider, said riser divider including an inner wall, said riser divider including an outer wall, said riser divider including a riser bottom edge, said riser bottom edge extending between said inner and said outer walls of said riser divider, said riser divider including a riser top edge, said riser top edge extending between said inner and said outer walls of said riser divider, at least a portion of said riser top edge directly attached to said bottom surface of said U-shaped rim, each said breathing chamber being segregated from the next adjacent breathing chamber by said at least one cross-brace divider, said at least one cross-brace divider comprising at least two cross-brace dividers, said at least two said cross-brace dividers extending diametrically across said inner wall of said riser divider, said at least two cross-brace dividers perpendicularly intersecting one another at said central axis, each said cross-brace divider including opposing side walls, each said cross-brace divider including a top ledge, each said cross-brace divider including a base, each said cross-brace divider including opposite cross-brace ends, each said cross-brace end perpendicularly abutting said inner wall of said riser divider, each said top ledge disposed in direct supporting contact with said under surface of said ventilated platform, each said cross-brace divider having an axial height generally equal to said uniform axial height of said riser divider, said riser bottom edge and said base of each said cross-brace divider being generally co-planar, said riser top edge and said top ledge of each said cross-brace divider being generally co-planar, each said stand-off divider substantially impervious to external air drafts such that said breathing chambers formed therebetween remain generally sequestered from external air exchanges when enclosed by a pizza and by a suitable remote surface, a handle attached to at least one of said plurality of stand-off dividers, said handle having a uniform thickness defined by opposing flat top and bottom panels, said handle attached adjacent to said riser bottom edge, said handle disposed within one of said breathing chambers, said flat bottom surface of said handle generally co-planar with said riser bottom edge and said base of each said cross-brace divider, said handle attached to opposing said side walls of two adjacent said cross-brace dividers, said riser divider including a drain hole adjacent said handle.

* * * * *